United States Patent [19]

Shoji et al.

[11] Patent Number: 4,953,362

[45] Date of Patent: Sep. 4, 1990

[54] REFRIGERATOR-FREEZER UNIT

[75] Inventors: Takeuchi Shoji, Gunma; Iino Katsuyoshi; Takahashi Ryoichi, both of Maebashi, all of Japan

[73] Assignee: Sanden Corporation, Japan

[21] Appl. No.: 377,252

[22] Filed: Jul. 10, 1989

[30] Foreign Application Priority Data

Jul. 8, 1988 [JP] Japan ..... 63-90597[U]
Jul. 8, 1988 [JP] Japan ..... 63-90598[U]

[51] Int. Cl.[5] ..... A47F 3/04

[52] U.S. Cl. ..... 62/246; 62/297; 62/298; 62/440; 312/116

[58] Field of Search ..... 62/246, 297, 298, 440, 62/255; 312/116, 236

[56] References Cited

U.S. PATENT DOCUMENTS

| | | | |
|---|---|---|---|
| 1,942,741 | 1/1934 | Austin | 62/297 X |
| 2,521,064 | 9/1950 | Kleist | 62/298 X |
| 2,880,596 | 4/1959 | Brown et al. | 62/246 |
| 3,153,918 | 10/1964 | Fink et al. | 62/297 |
| 3,797,903 | 3/1974 | Traulsen | 312/116 |
| 4,602,827 | 7/1986 | Casanova | 62/246 X |
| 4,660,903 | 4/1987 | Shinagawa | 312/116 |
| 4,840,439 | 6/1989 | Nara et al. | 312/116 |
| 4,898,004 | 2/1990 | Richardson | 62/298 |

FOREIGN PATENT DOCUMENTS

| | | |
|---|---|---|
| 60-38921 | 11/1985 | Japan . |
| 63-20946 | 6/1988 | Japan . |

*Primary Examiner*—Lloyd L. King
*Attorney, Agent, or Firm*—Banner, Birch, McKie & Beckett

[57] ABSTRACT

A refrigerator-freezer unit including a machine room, a cold room, pillars for the machine room, pillars for the cold room, and a frame disposed between both rooms and having fittings which can connect the top portion of each machine room pillar and the bottom portion of each cold room pillar. Since the rigidity of the cold room pillars can be increased by connecting the pillars to the fittings of the rigid frame, the torsion and deflection of the pillars can be prevented even when external forces operate on the cold room. Moreover, since the parallelism of the cold room pillars can be maintained by the increase of the rigidity, a simple structure for the attachment of a guide plate, using only engagement mechanism without screws, can be easily employed, thereby making the attachment and removal of the guide plate easy and quick.

15 Claims, 10 Drawing Sheets

REFRIGERATOR-FREEZER UNIT

BACKGROUND OF THE INVENTION

1. Field of the Invention

The present invention relates to a refrigerator-freezer unit having a machine room for a refrigerator on the lower portion thereof and a cold room for goods to be cooled on the upper portion thereof.

2. Description of the Prior Art

The conventional refrigerator-freezer unit has a machine room on the lower portion thereof for a refrigerator and a cold room on the upper portion thereof in which goods to be cooled are placed and which is usually used as a show case. The unit is typically shaped in a quadrangle in its cross section. The machine room is constructed of a bottom plate, four pillars vertically extending and fixed to four corners of the bottom plate, a reinforcing member connected to the middle portions of the pillars and cover plates attached to the outside surfaces of the pillars. A refrigerator comprising a compressor, a condenser, an expansion means, an evaporator, a blower means and so forth is placed in the machine room. The cold room is constructed of a roof plate, four pillars vertically extending and fixed to four corners of the roof plate, a bottom plate disposed between the cold room and the machine room, three side walls disposed between adjacent pillars and usually constructed from glass, and a door free to open and close and usually constituting one side wall.

The machine room and the cold room are connected to each other and assembled as a single unit by directly connecting machine room pillars and cold room pillars via screws or by welding.

In such a conventional unit, however, although the top portions of the cold room pillars are fixed to the roof plate of the cold room, the bottom portions thereof are merely connected to the top portions of the machine room pillars, respectively. Therefore, the cold room pillars are not very rigid. When an external force operates on the cold room, it may be difficult for the cold room pillars to maintain their parallel relation in the vertical direction and torsion or deflection of the cold room pillars can occur.

On the other hand, the bottom plate of the cold room has an opening through which cold air passes from the machine room to the cold room, and a guide plate is usually disposed on the portion of the opening in order to efficiently circulate the cold air sent from the opening to the inside of the cold room. This guide plate is usually fixed at its bottom portion to the edge portion defining the opening via an appropriate engaging means and fixed at its side portions to cold room pillars via screws.

In such a conventional structure, attaching and removing the guide plate are relatively difficult procedures. The procedures are relatively long since a tool must be used to fasten and unfasten the screws and the cold room is usually not wide enough to provide a sufficiently large working space. Moreover, in the aforementioned structure wherein the rigidity of the cold room pillars is relatively low, it is sometimes difficult to fit the fastening portions of the guide plate to the fastening portions of the cold room pillars due to the torsion or deflection of the cold room pillars.

SUMMARY OF THE INVENTION

Accordingly, an object of the present invention is to provide a refrigerator-freezer unit having a cold room whose pillars have a rigidity sufficient to prevent their torsion and deflection even when external forces operate on the cold room.

Another object of the present invention is to provide a refrigerator-freezer unit whose guide plate for cold air can be easily attached and removed without using a tool.

Directed to achieving these objects, a refrigerator-freezer unit is herein provided. The unit has a machine room for a refrigerator on the lower portion thereof and a cold room for cooling goods on the upper portion thereof. Vertically extending pillars are provided for the machine room, and vertically extending pillars are provided for the cold room. The bottom portion of each of the cold room pillars is substantially connected to the top portion of each of the machine room pillars. A frame is disposed between the machine room and the cold room, and the frame has a plurality of fitting means to each of which both of the top portion of each machine room pillar and the bottom portion of each cold room pillar are respectively fitted.

In the refrigerator-freezer unit, the bottom portions of the cold room pillars and the top portions of the machine room pillars are connected via fitting means provided on the frame. Since the bottom portions of the cold room pillars are fixed to the fitting means and the fitting means are provided on the rigid frame, the cold room pillars can have a sufficient rigidity. Therefore, the parallel relation of the cold room pillars can be maintained and torsion and deflection of the pillars can be prevented, even when an external force is applied to the cold room.

Moreover, since the cold room pillars can accurately maintain their parallel relationship, a simple structure for the attachment of a guide plate for cold air can be used, and the guide plate can be attached and fixed with the cold room pillars simply by an engaging mechanism. Namely, the guide plate is disposed on the portion of a cold air opening formed on a bottom plate, for the cold room and through which cold air passes from the machine room to the cold room. Engaging means are/is provided on at least one of the cold room pillars. At least one first engaging portion engaging an edge portion defining the opening of the bottom plate and at least one second engaging portion engaging the engaging means are provided on the guide plate. The guide plate can be easily attached and fixed only by the engagement of the first engaging portion with the edge portion and the engagement of the second engaging portion with the engaging means without using screws and associated tools.

BRIEF DESCRIPTION OF THE DRAWINGS

Preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE PRESENT INVENTION

Figure 1:
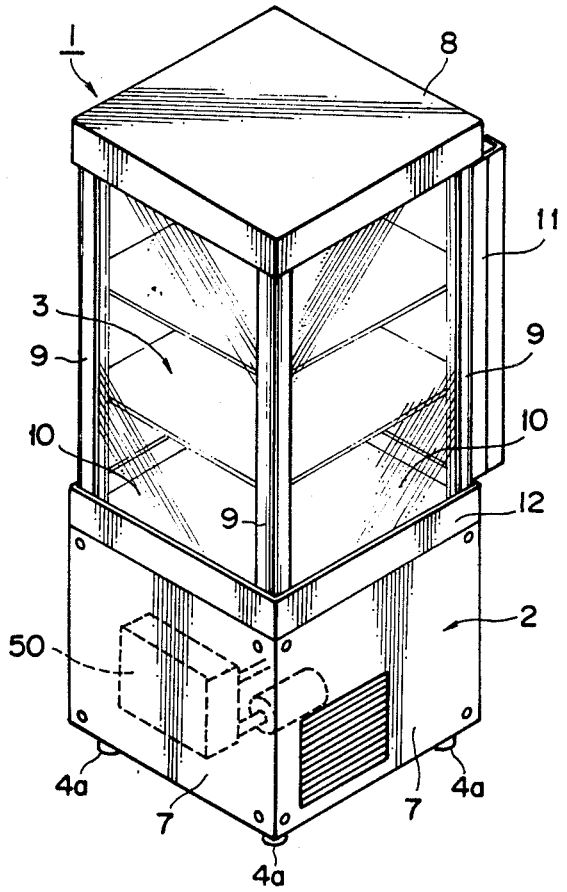
FIG. 1 is a perspective view of a refrigerator-freezer unit according to one embodiment of the present invention.

Referring to the drawings, FIGS. 1-5 illustrate a refrigerator-freezer unit according to an embodiment of the present invention. As shown in FIG. 1, a refrigerator-freezer unit 1 has a machine room 2 on the lower portion thereof and a cold room 3 on the upper portion thereof.

Figure 2:
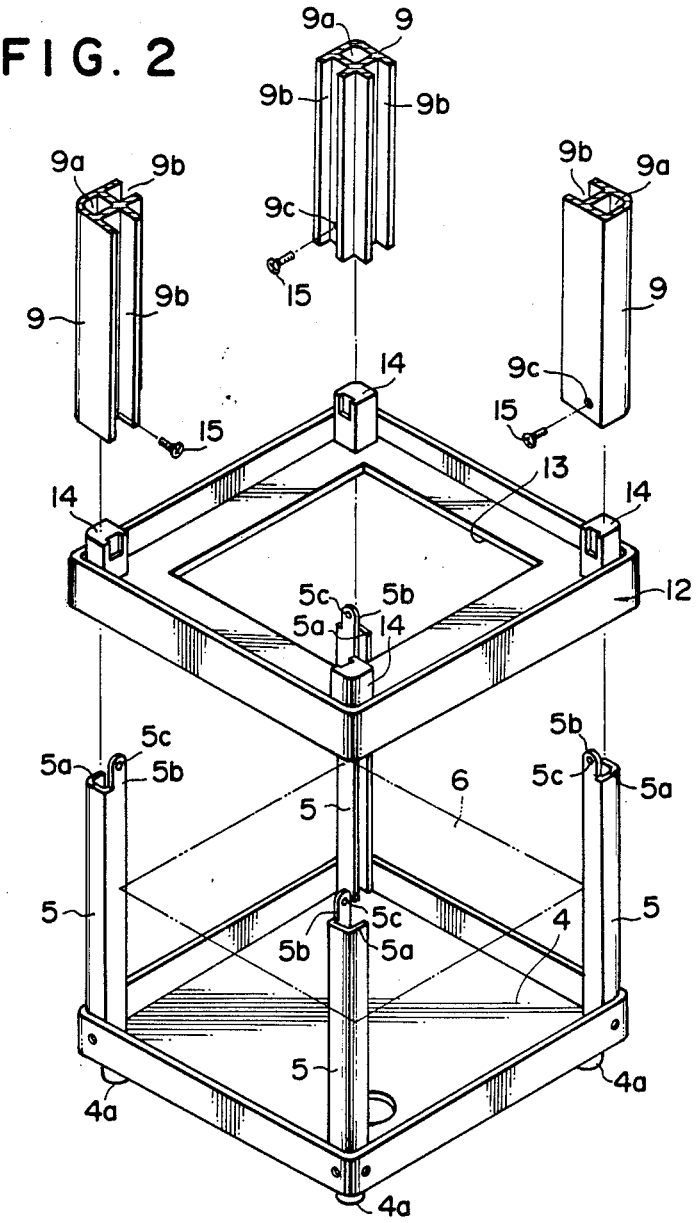
FIG. 2 is an exploded perspective view of a part of the unit shown in FIG. 1.

Also as shown in FIG. 2, machine room 2 comprises a bottom plate 4 provided with a plurality of casters 4*a* on the lower surface thereof, four pillars 5 extending vertically up from the upper surface of the bottom plate and fixed on the four corners of the bottom plate by welding or screws, a reinforcing plate 6 fixed to the middle portions of the pillars by welding or screws, and cover plates 7 fixed to the outer surfaces of the pillars via screws. A refrigerator 50 comprising a compressor, a condenser, an expansion means, an evaporator, a blower means and so forth is placed in the machine room 2.

Cold room 3 comprises a roof plate 8, four plastic pillars 9 vertically extending downwardly from the lower surface of the roof plate and fixed on the four corners of the roof plate by fittings or screws, glass plates 10 disposed between the adjacent pillars and constituting three side walls of the cold room, and a door 11 free to open and close and forming one side wall of the cold room when closed. Goods such as foods to be cooled (not shown) are placed in this cold room 3.

A frame 12 is disposed between machine room 2 and cold room 3. Frame 12, machine room 2 and cold room 3 are each rectangularly shaped, and the frame has a through hole 13 on its central portion. Four fitting tubes 14 are provided on the four corners of frame 12 and are constructed substantially integrally with the frame. Fitting tubes 14 vertically extend upwardly from the upper surface of frame 12 and the fitting tubes open downward and close at their top positions, respectively.

Each machine room pillar 5 is nearly L-shaped in cross section. Each pillar 5 has a vertically engaging portion 5*a* and a portion 5*b* vertically projecting from the engaging portion and having a tapped hole 5*c* on its top portion. Each cold room pillar 9 is, in cross section, shaped in nearly a box having a vertically extending through hole 9*a*. Each pillar 9 located on the door side has a groove 9*b* vertically extending on a side surface of the pillar, and each pillar 9 located on the side opposite to the door side has two grooves 9*b* disposed at a ninety degree angle. Both side edge portions of each glass plate 10 are inserted into and supported in grooves 9*b* confronting each other on a pair of pillars 9.

Figure 3:
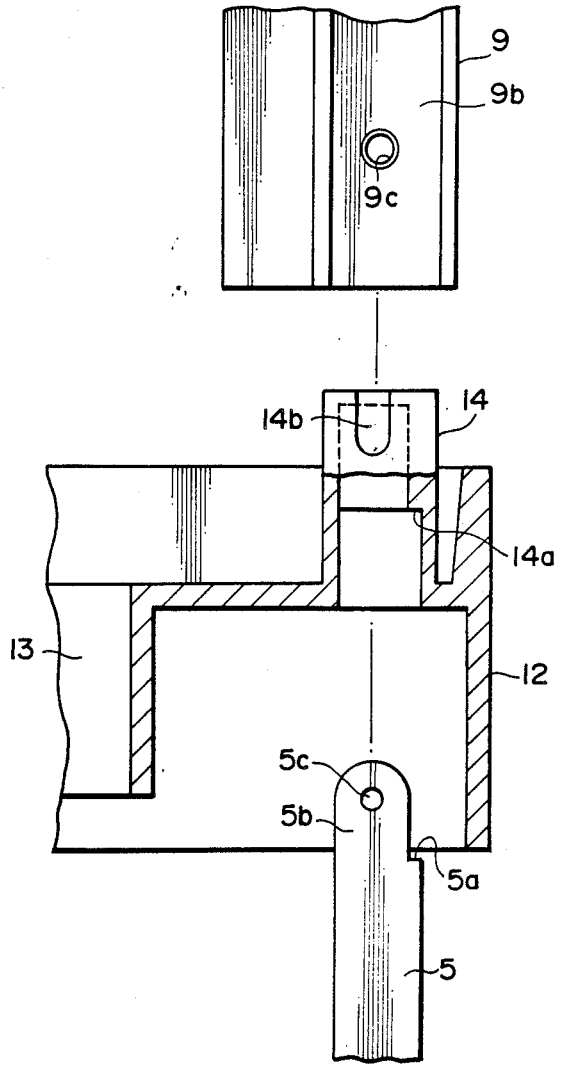
FIG. 3 is an enlarged side view, partially cut away, of a part of the unit shown in FIG. 2.
Figure 4:
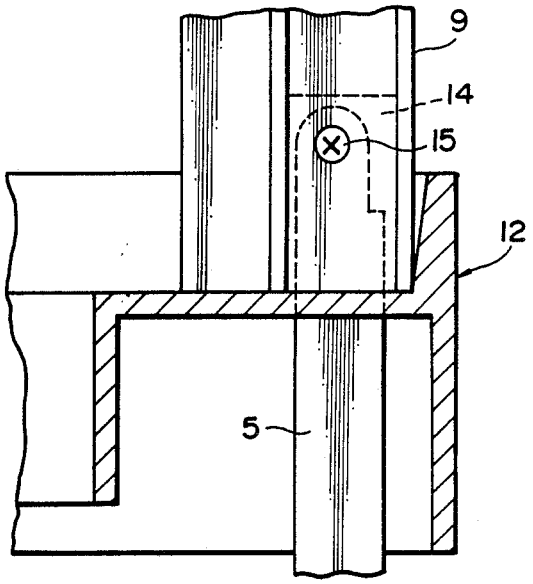
FIG. 4 is a side view, partially cut away, of the part shown in FIG. 3, illustrating the assembled state of the part.
Figure 5:
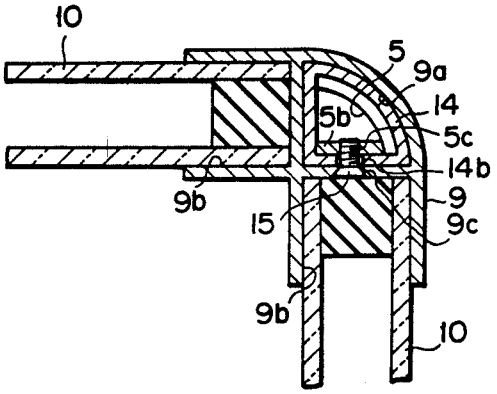
FIG. 5 is a cross sectional view of the part shown in FIG. 4.

A portion connecting the top portion of each machine room pillar 5 and the bottom portion of each cold room pillar 9 via each fitting tube 14 is now explained with reference to FIGS. 3-5. The top portion of machine room pillar 5, including engaging portion 5*a* and projecting portion 5*b*, is inserted into the inside of fitting tube 14. A stepped portion 14*a* is formed in fitting tube 14, and the inserted top portion of machine room pillar 5 is stopped in its inserting motion by the engaging portion 5*a* engaging the stepped portion.

The bottom portion of cold room pillar 9 is fitted onto the outside of fitting tube 14 by moving the pillar downward from upside. The downward movement of pillar 9 is stopped by bringing its lower end surface into contact with the upper surface of frame 12.

A through hole 9*c* for a screw 15 is formed on the bottom portion of cold room pillar 9 and a vertically extending through slot 14*b* for the screw is defined on a side surface of fitting tube 14. Through hole 9*c*, through slot 14*b* and tapped hole 5*c* are arranged on the same horizontal axis in the state where the top portion of machine room pillar 5 is inserted into fitting tube 14 to a predetermined extent and the bottom portion of cold room pillar 9 is fitted downwardly to the fitting tube to a predetermined extent, respectively. Thereafter, screw 15 is inserted into through hole 9*c* and through slot 14*b* and screwed into tapped hole 5*c*. Thus, the top portion of machine room pillar 5 and the bottom portion of cold room pillar 9 are fixed to fitting tube 14 via screw 15.

In this embodiment, since the bottom portion of each cold room pillar 9 is connected to the top portion of each machine room pillar 5 via fitting tube 14 provided on a sufficiently rigid frame 12, the cold room pillar also can be very rigid. As a result, the desired parallelism of four cold room pillars 9 can be maintained and the torsion and deflection of each pillar 9 can be easily prevented even when an external force is applied to cold room 3.

Moreover, since the top portion of each machine room pillar 5 and the bottom portion of each cold room pillar 9 are connected substantially only by the fitting of pillar 5 to fitting tube 14 and the fitting of pillar 9 to the fitting tube, the connection work is very easy. When screw 15 is used for fixing of pillar 5, pillar 9 and fitting tube 14, these three members can be fixed more strongly, and the pillar 9 made more rigid. If the fitting strengths between pillar 5 and fitting tube 14 and between pillar 9 and the fitting tube are sufficiently great, screw 15 may be altered to be merely a pin for positioning these members in the vertical direction or may be omitted.

Furthermore, since engaging portion 5*a* of machine room pillar 5 vertically engages stepped portion 14*b* in fitting tube 14, a substantially vertical load does not operate on projecting portion 5*b*. Therefore, deformation of projecting portion 5*b* before fastening by screw 15 can be prevented, the desired position of tapped hole 5*c* can be maintained, and the screw can be easily inserted. Since a through hole for screw 15 on fitting tube 14 is formed as a vertical through slot 14*b*, the screw can be easily inserted as long as through hole 9c and tapped hole 5c are set to the same level in the vertical direction.

Figure 6:
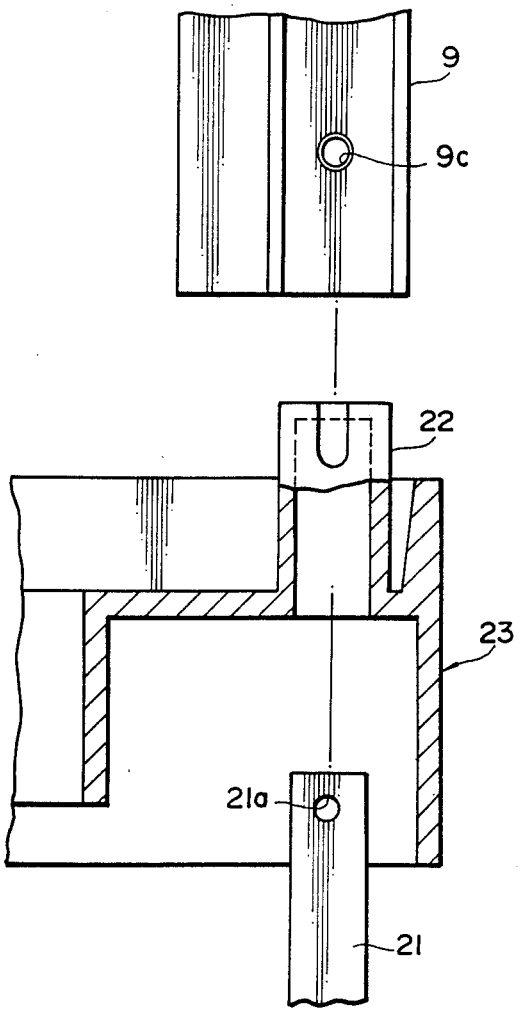
FIG. 6 is a side view, partially cut away, of a part of a refrigerator-freezer unit according to another embodiment of the present invention.
Figure 7:
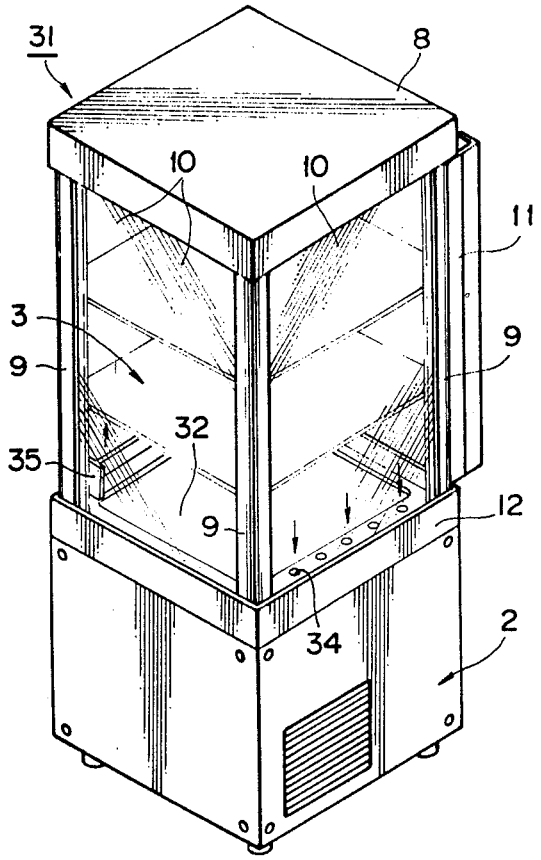
FIG. 7 is a perspective view of a refrigerator-freezer unit according to a further embodiment of the present invention.
Figure 8:
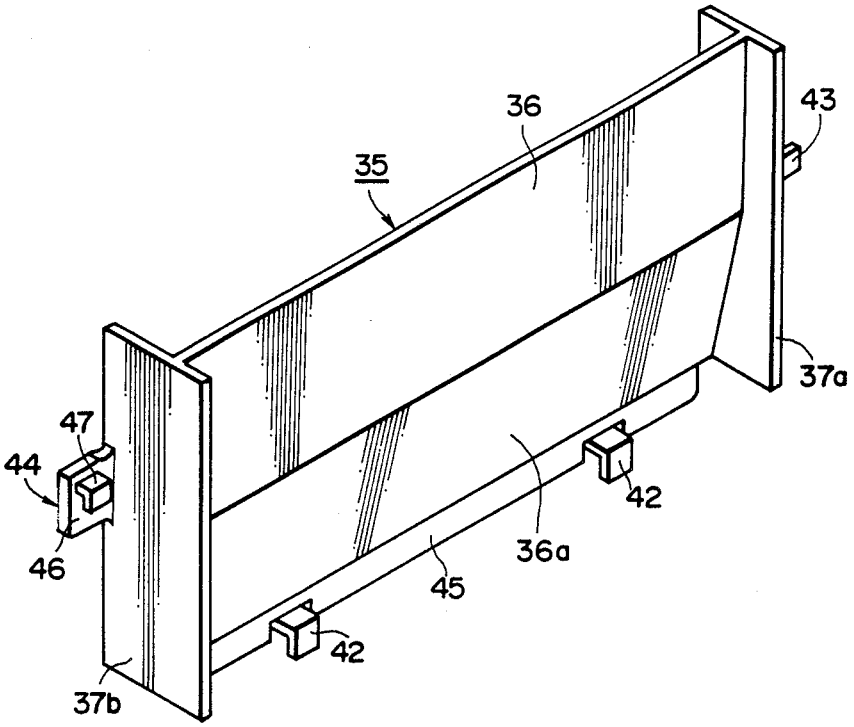
FIG. 8 is an enlarged perspective view of a guide plate of the unit shown in FIG. 7.
Figure 9:
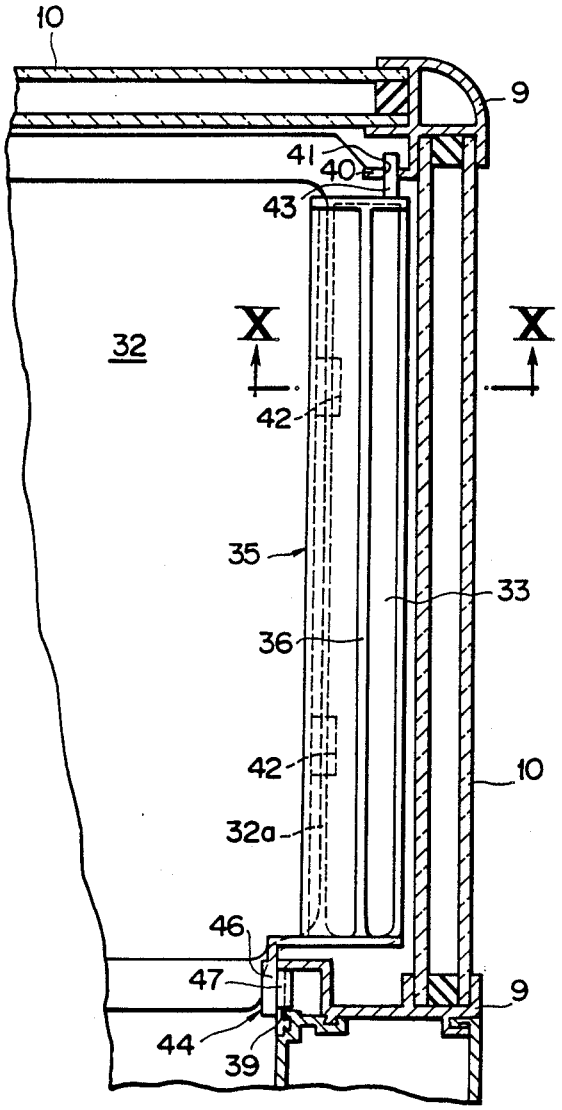
FIG. 9 is an enlarged cross sectional view of a part of the unit shown in FIG. 7.

With respect to vertical engagement of a machine room pillar or a cold room pillar with a fitting tube, a structure such as shown in FIG. 6 may be employed. In FIG. 6, a machine room pillar 21 does not have a projecting portion on its top portion and a stepped portion is not formed in a fitting tube 22 provided on a frame 23. The top end surface of machine room pillar 21 is brought into contact with the inner upper surface of fitting tube 22 and the pillar and a hole 21a for a screw are positioned in the vertical direction by this contact. Cold room pillar 9 is vertically positioned in the same manner as in the aforementioned embodiment shown in FIGS. 3 and 4.

FIGS. 7–10, 11A and 11B show another embodiment of the present invention wherein a guide plate for cold air is provided in a refrigerator-freezer unit. A refrigerator-freezer unit 31 has substantially the same structures of machine room 2, cold room 3, roof plate 8 of the cold room, cold room pillars 9, glass plates 10, door 11 and frame 12 having fitting tubes as those in the aforementioned embodiment shown in FIGS. 1–5, and so, the same numerals for these members are used as those used in FIGS. 1–5.

A bottom plate 32 for cold room 3 is provided between the cold room and machine room 2. A cold air opening 33 through which cold air passes from machine room 2 to cold room 3 is formed on the periphery portion of a side of bottom plate 32. A plurality of intake ports 34 are formed on the periphery portion of a side opposite to the position of opening 33 of bottom plate 32 for circulating cold air from cold room 3 to machine room 2.

A guide plate 35 is disposed on the portion of opening 33 for guiding cold air from the opening to the inside of cold room 3 through a space between the guide plate and glass plate 10. This guide plate 35 has a main plate portion 36 including a slope portion 36a and side plates 37a and 37b provided on both sides of the main plate portion.

An edge portion 32a defining opening 33 on bottom plate 32 extends upwardly. Engaging means 38 and 39 are provided on two adjacent cold room pillars 9. One of the engaging means—engaging means 38—is constructed of a support piece 40 projecting horizontally from cold room pillar 9 and a groove 41 defined on the piece and upwardly opening. The other of the engaging means—engaging means 39—is constituted as a square-shaped hole and formed by cutting away a part of a side wall of cold room pillar 9.

Guide plate 35 has two first engaging portions 42 on the bottom portion thereof and two second engaging portions 43 and 44 on the outer surfaces of respective side plates 37a and 37b. Each first engaging portion 42 is L-shaped in vertical section. First engaging portion 42 engages edge portion 32a defining opening 33, and the edge portion is held between the first engaging portion and residual bottom end portion 45 of main plate portion 36 of guide plate 35. One of the second engaging portions—second engaging portion 43—is constructed of a piece projecting horizontally from side plate 37a. This second engaging portion 43 is inserted into groove 41 of engaging means 38 and held in the groove. The other second engaging portions—second engaging portion 44—is constructed of a support piece 46 projecting horizontally from another side plate 37b and a hook portion 47 provided on a side surface of the support piece and L-shaped in its vertical section. Hook portion 47 of this second engaging portion 44 is inserted into hole 39, and an edge portion defining the hole is held between the hook portion and support piece 46.

Figure 10:
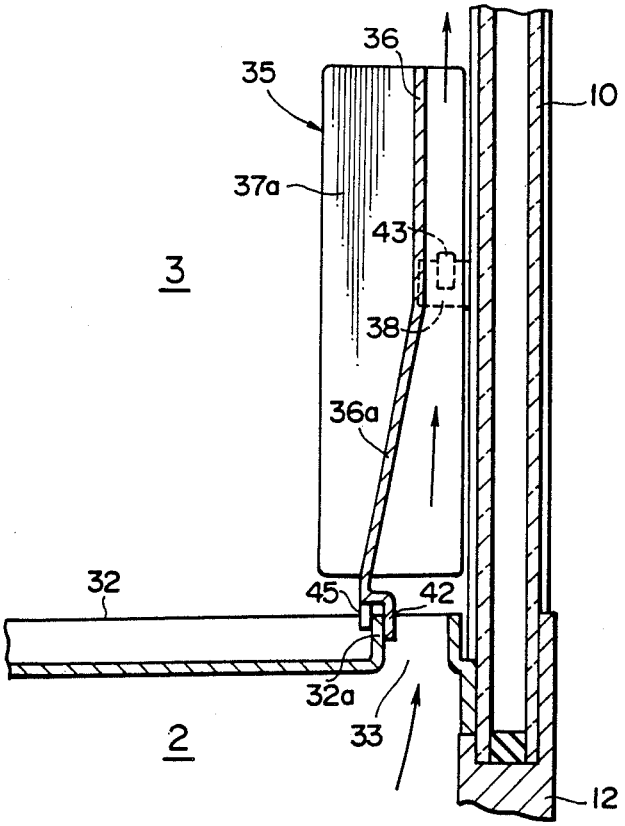
FIG. 10 is a vertical sectional view of the part shown in FIG. 9 taken along line X—X of FIG. 9.
Figure 11A:
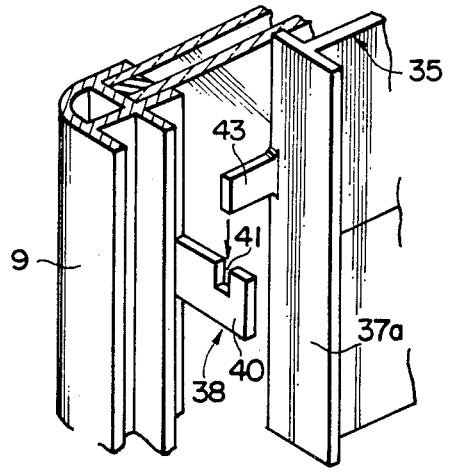
FIGS. 11A and 11B are perspective views of engaging portions of the guide plate shown in FIG. 8 and engaging means of the pillars.
Figure 11B:
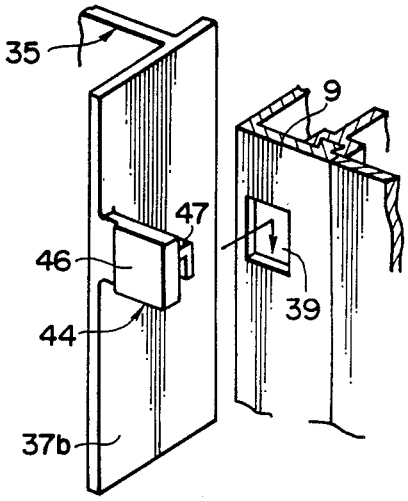

In this embodiment, guide plate 35 is attached in cold room 3 as follows. As shown in FIGS. 11A and 11B, after guide plate 35 is positioned above opening 33 and parallel with glass plate 10, hook portion 47 of second engaging portion 44 on side plate 37b is inserted into hole 39 formed on cold room pillar 9, and thereafter, the guide plate is lowered. Second engaging portion 44 engages engaging means 39, namely, hook portion 47 and support piece 46 hold an edge portion defining hole 39, and at the same time, another second engaging portion 43 engages another engaging means 38, namely, a projecting piece as the second engaging portion 43 is inserted into groove 41 defined on support piece 40 and held in the groove. When guide plate 35 is lowered as described above, first engaging portions 42 engage edge portion 32a defining opening 33 as shown in FIG. 10. More specifically, the first engaging portions 42 and bottom end portion 45 hold the edge portion 32a. Thus, the attachment of guide plate 35 is completed. In this state, cold air blown up from machine room 2 through opening 33 flows upwardly through a space surrounded by main plate portion 36 and side plates 37a and 37b of guide plate 35 and glass plate 10 and the cold air is sent to the inside of cold room 3, as shown with arrows in FIG. 10.

When guide plate 35 is removed from cold room 3, first engaging portions 42, second engaging portion 43 and hook portion 47 are detached from edge portion 32a, groove 41 and the edge portion defining hole 39, respectively, by pulling up the guide plate. Thereafter, hook portion 47 is pulled horizontally out from hole 39.

In the structure for the attachment of guide plate 35 as described above, since the guide plate can be easily attached merely by the engagement of first engaging portions 42 with edge portion 32a and the engagement of second engaging portions 43 and 44 with engaging means 38 and 39, screws and a tool are not required for attaching and removing the guide plate. Therefore, the guide plate 35 can be easily and quickly attached and removed even if the inside space of cold room 3 is relatively small.

Moreover, since second engaging portions 43 and 44 are disposed on both sides of guide plate 35 and the second engaging portions and first engaging portions 42 are fitted to engaging means 38 and 39 and edge portion 32a, the attached guide plate cannot be shaken by the pressure of blown up cold air and the generation of noise due to the vibration of the guide plate can also be prevented.

Such a simple and excellent structure for the attachment of guide plate 35 can be achieved more easily by using the structure provided with frame 12 having fitting tubes which are, for example, shown in FIGS. 1–5 of the aforementioned embodiment. Since the parallel cold room pillars 9 are made more rigid by their connection to the fitting tubes, the positions of engaging means 38 and 39 on the pillars can be accurately and easily maintained for a long period of time. As a result, each engaging portion can easily and accurately engage the corresponding engaging means, the attaching and removing the guide plate 35 can be easier and the guide plate more strongly fixed.

Although guide plate 35 has two first engaging portions 42 in this embodiment, it may have a single first engaging portion. Two second engaging portions 43 and 44 and the corresponding engaging means 38 and 39 have structures different from each other in this embodiment, the same structure may be used on both sides of the guide plate. Furthermore, a second engaging portion can be provided only on a single side of a guide plate if the guide plate is sufficiently rigid and the second engaging portion is strongly fixed to a corresponding engaging means.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of this invention as defined by the following claims.

What is claimed is:

1. A refrigerator-freezer unit comprising:

a lower machine room for a refrigerator;

an upper cold room for cooling goods and positioned generally above said lower machine room;

vertical machine room pillars associated with said lower machine room, said machine room pillars having machine room pillar top portions;

vertical cold room pillars associated with said upper cold room, said cold room pillars having cold room pillar bottom portions substantially connected to said machine room pillar top portions; and a frame disposed between said machine room and said cold room, said frame having a plurality of fitting means onto which both said machine room pillars top portions and said cold room pillar bottom portions are fitted.

2. The unit according to claim 1 wherein said machine room and said cold room are shaped as quadrangles, respectively, in their horizontal cross sections and said machine room pillars, said cold room pillars and said fitting means are disposed on the four corners of said quadrangles, respectively.

3. The unit according to claim 1 wherein said fitting means are formed as a vertical tube.

4. The unit according to claim 3 wherein said fitting means extend upwardly from the upper surface of said frame, said top portion of each machine room pillar is inserted into the inside of each of said fitting means, and said bottom portion of each cold room pillar is fitted onto the outside of each of said fitting means.

5. The unit according to claim 1 wherein said top portion of each machine room pillar and said bottom portion of each cold room pillar are screwed to each of said fitting means.

6. The unit according to claim 5 wherein a stepped portion is formed in each of said fitting means and at least one of said top portion of each machine room pillar and said bottom portion of each cold room pillar has a portion vertically engaging said stepped portion and a portion vertically projecting from said engaging portion and having a screw hole for a screw.

7. The unit according to claim 5 wherein a vertically extending through slot for a screw is defined on each of said fitting means.

8. The unit according to claim 1 wherein at least one of said machine room pillars and said cold room pillars are positioned in the vertical direction by bringing their end surfaces into contact with one of the inner surfaces of said fitting means and the surface of said frame.

9. The unit according to claim 1 wherein said cold room pillars are constructed from a plastic.

10. The unit according to claim 1 further comprising:

a bottom plate for said cold room provided between said cold room and said machine room and having an opening through which cold air passes from said machine room to said cold room;

engaging means on at least one of said cold room pillars; and a guide plate disposed on the portion of said opening for guiding cold air from said opening to the inside of said cold room, said guide plate having at least one first engaging portion which engages an edge portion defining said opening and at least one second engaging portion which engages said engaging means.

11. The unit according to claim 10 wherein said engaging means are provided on two adjacent cold room pillars, and said guide plate has said second engaging portion on each side thereof.

12. The unit according to claim 10 wherein said guide plate has a side plate on each side thereof.

13. The unit according to claim 10 wherein said engaging means has an upwardly opening groove and said second engaging portion is inserted into said groove.

14. The unit according to claim 10 wherein said engaging means comprises a hole formed by cutting away a part of a side wall of said cold room pillar, and said second engaging portion is formed as a hook-like shape inserted into said hole.

15. The unit according to claim 10 wherein said edge portion defining said opening extends upwardly.

* * * * *